US005558256A

United States Patent [19]

Miller et al.

[11] Patent Number: 5,558,256

[45] Date of Patent: Sep. 24, 1996

[54] BOTTLED WATER SUPPLY SYSTEM

[76] Inventors: Edward J. Miller, 3919 Pixie Ave., Lakewood, Calif. 90712; Michelle R. Irvine, 81820 Shadow Palm St., Apt. #9, Indio, Calif. 92201

[21] Appl. No.: 398,966

[22] Filed: Mar. 2, 1995

[51] Int. Cl.[6] ..... B67D 5/58

[52] U.S. Cl. ..... 222/189.09; 222/63

[58] Field of Search ..... 222/189.09, 63, 222/146.6; 62/390, 340, 397

[56] References Cited

U.S. PATENT DOCUMENTS 4,830,233 5/1989 Priest ..... 222/146.6

4,941,806 7/1990 Brown et al. ..... 62/397

4,987,746 1/1991 Roberts ..... 62/340

*Primary Examiner*—Gregory L. Huson

[57] ABSTRACT

A system for supplying water from a bottle to a faucet and an auxiliary device on demand. The inventive device includes a water bottle for storing a quantity of fresh water. A demand pump fluidly communicates with the water bottle and creates a pressurized output of water from the bottle. The demand pump is responsive to a drop in output pressure such as occurs during opening of a faucet or operation of a refrigerator ice-maker so as to supply water from the water bottle to such devices.

1 Claim, 4 Drawing Sheets

BOTTLED WATER SUPPLY SYSTEM

BACKGROUND OF THE INVENTION

1. Field of the Invention

The present invention relates to fluid supply structures and more particularly pertains to a bottled water supply system for supplying water from a bottle to a faucet and an auxiliary device on demand.

2. Description of the Prior Art

The use of fluid supply structures is known in the prior art. More specifically, fluid supply structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art fluid supply structures include U.S. Pat. No. 5,307,958; U.S. Pat. No. 5,197,866; U.S. Pat. No. 5,114,042; U.S. Pat. No. 4,941,806; U.S. Pat. No. 4,881,380; and U.S. Pat. No. 4,735,345.

While these devices fulfill their respective, particular objectives and requirements, the aforementioned patents do not disclose a bottled water supply system for supplying water from a bottle to a faucet and an auxiliary device on demand which includes a water bottle for storing a quantity of fresh water, and demand pump fluidly communicating with the water bottle for creating a pressurized output of water from the bottle, wherein the demand pump is responsive to a drop in output pressure such as occurs during opening of a faucet or operation of a refrigerator ice-maker so as to supply water from the water bottle to such devices.

In these respects, the bottled water supply system according to the present invention substantially departs from the conventional concepts and designs of the prior art, and in so doing provides an apparatus primarily developed for the purpose of supplying water from a bottle to a faucet and an auxiliary device on demand.

SUMMARY OF THE INVENTION

In view of the foregoing disadvantages inherent in the known types of fluid supply structures now present in the prior art, the present invention provides a new bottled water supply system construction wherein the same can be utilized for supplying water from a bottle to a faucet and a auxiliary device. As such, the general purpose of the present invention, which will be described subsequently in greater detail, is to provide a new bottled water supply system apparatus and method which has many of the advantages of the fluid supply structures mentioned heretofore and many novel features that result in a bottled water supply system which is not anticipated, rendered obvious, suggested, or even implied by any of the prior art fluid supply structures, either alone or in any combination thereof.

To attain this, the present invention generally comprises a system for supplying water from a bottle to a faucet and an auxiliary device on demand. The inventive device includes a water bottle for storing a quantity of fresh water. A demand pump fluidly communicates with the water bottle and creates a pressurized output of water from the bottle. The demand pump is responsive to a drop in output pressure such as occurs during opening of a faucet or operation of a refrigerator ice-maker so as to supply water from the water bottle to such devices.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bottled water supply system apparatus and method which has many of the advantages of the fluid supply structures mentioned heretofore and many novel features that result in a bottled water supply system which is not anticipated, rendered obvious, suggested, or even implied by any of the prior art fluid supply structures, either alone or in any combination thereof.

It is another object of the present invention to provide a new bottled water supply system which may be easily and efficiently manufactured and marketed.

It is a further object of the present invention to provide a new bottled water supply system which is of a durable and reliable construction.

An even further object of the present invention is to provide a new bottled water supply system which is susceptible of a low cost of manufacture with regard to both materials and labor, and which accordingly is then susceptible of low prices of sale to the consuming public, thereby making such bottled water supply systems economically available to the buying public.

Still yet another object of the present invention is to provide a new bottled water supply system which provides in the apparatuses and methods of the prior art some of the advantages thereof, while simultaneously overcoming some of the disadvantages normally associated therewith.

Still another object of the present invention is to provide a new bottled water supply system for supplying water from a bottle to a faucet and an auxiliary device on demand.

Yet another object of the present invention is to provide a new bottled water supply system which includes a water bottle for storing a quantity of fresh water, and demand pump fluidly communicating with the water bottle for creating a pressurized output of water from the bottle, wherein the demand pump is responsive to a drop in output pressure such as occurs during opening of a faucet or operation of a refrigerator ice-maker so as to supply water from the water bottle to such devices.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
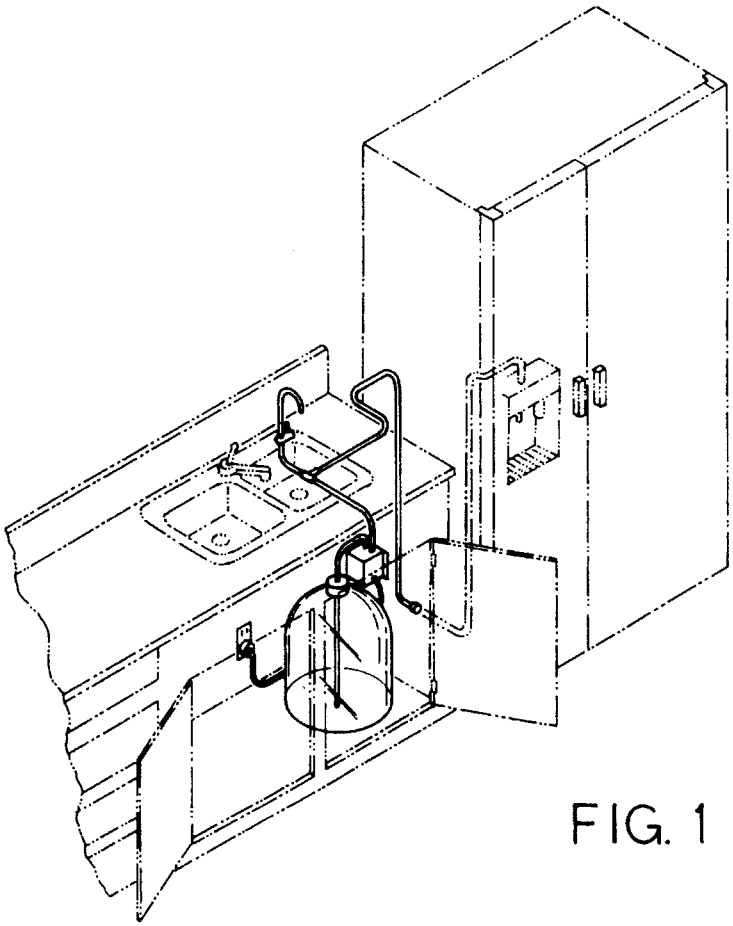
FIG. 1 is an isometric illustration of a bottled water supply system according to the present invention in use.

With reference now to the drawings, and in particular to FIGS. 1–8 thereof, a new bottled water supply system embodying the principles and concepts of the present invention and generally designated by the reference numeral 10 will be described.

More specifically, it will be noted that the bottled water supply system 10 comprises a water bottle 12 for receiving and storing a quantity of fresh water such as is commonly supplied by commercially available sources. The water bottle 12 is shaped so as to define an unlabeled cylindrical body tapering to a neck of reduced cross sectional diameter. A filter cap 14 is secured to the neck of the water bottle 12 and includes a sump conduit 16 extending through an interior of the water bottle to terminate proximal to a lower end thereof. An intake conduit 18 extends from the filter cap 14 and in communication with the sump conduit 16 to couple and fluidly communicate with a demand pump 20. An output conduit 22 extends from the demand pump 20 and into communication with a faucet conduit 24 communicating with a faucet 26. If desired, an auxiliary conduit 28 can be positioned into fluid communication with the output conduit 22 for coupling the output conduit to an auxiliary device such as a refrigerator ice-maker. The demand pump 20 operates to maintain a predetermined pressure within the output conduit 22 such that a pressure drop will effect automatic operation of the demand pump 20 to supply water or other fluids from the water bottle 12 to the output conduit 22 and the faucet conduit 24 and/or auxiliary conduit 28. By this structure, an operation of the faucet 26 and/or the refrigerator ice-maker will result in a continuous supply of water from the water bottle 12 by the demand pump 20 in response thereto.

Figure 3:
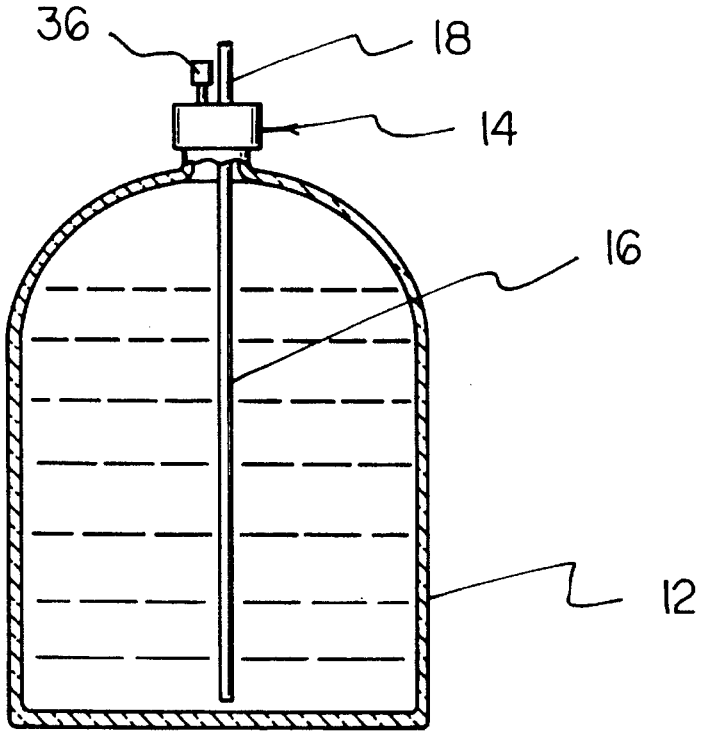
FIG. 3 is a cross sectional view of a water bottle comprising a portion of the present invention.
Figure 4:
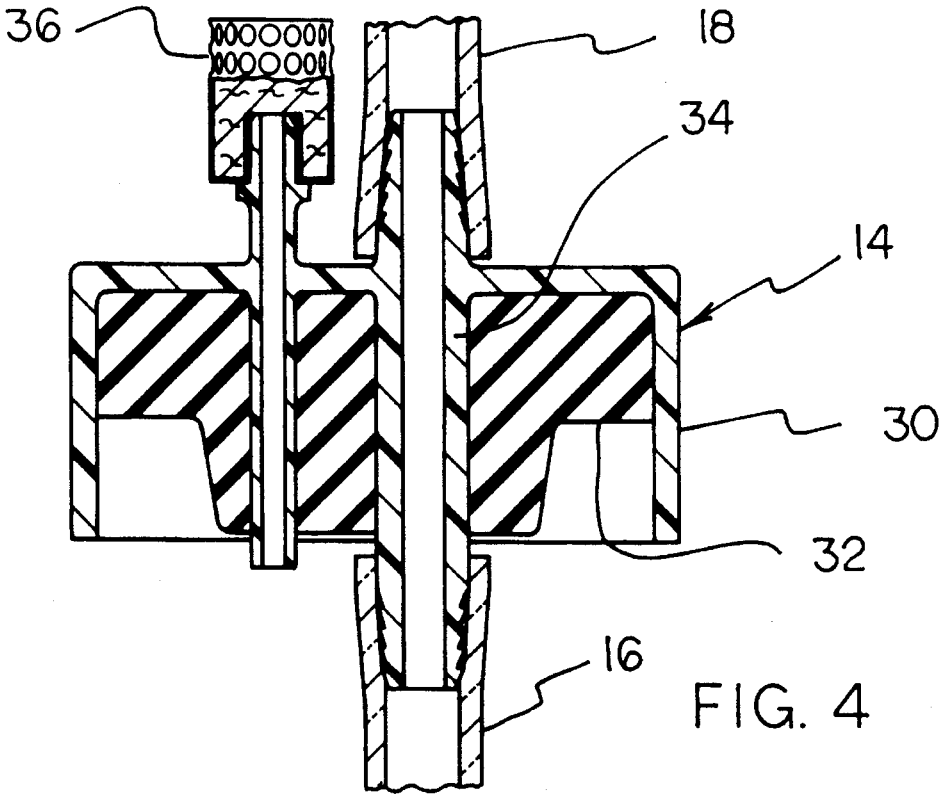
FIG. 4 is a cross sectional view of a filter cap comprising a further portion of the present invention.

Referring now to FIGS. 3 and 4 of the drawings, it can be shown that the filter cap 14 according to the present invention 10 comprises a closed cylindrical cap 30 having a seal 32 engaging the neck of the water bottle 12. A connector 34 extends through the closed cylindrical cap 30 and couples the sump conduit 16 to the intake conduit 18. An air filter 36 is positioned into fluid communication with an interior of the water bottle 12 and operates to filter air vented into the interior of the water bottle 12 during removal of fluids therefrom. By this structure, the filter cap 14 can be easily coupled to interchangeable water bottles 12, with the air filter 26 filtering air entering such water bottle to maintain the water in a fresh condition therewithin.

Figure 5:
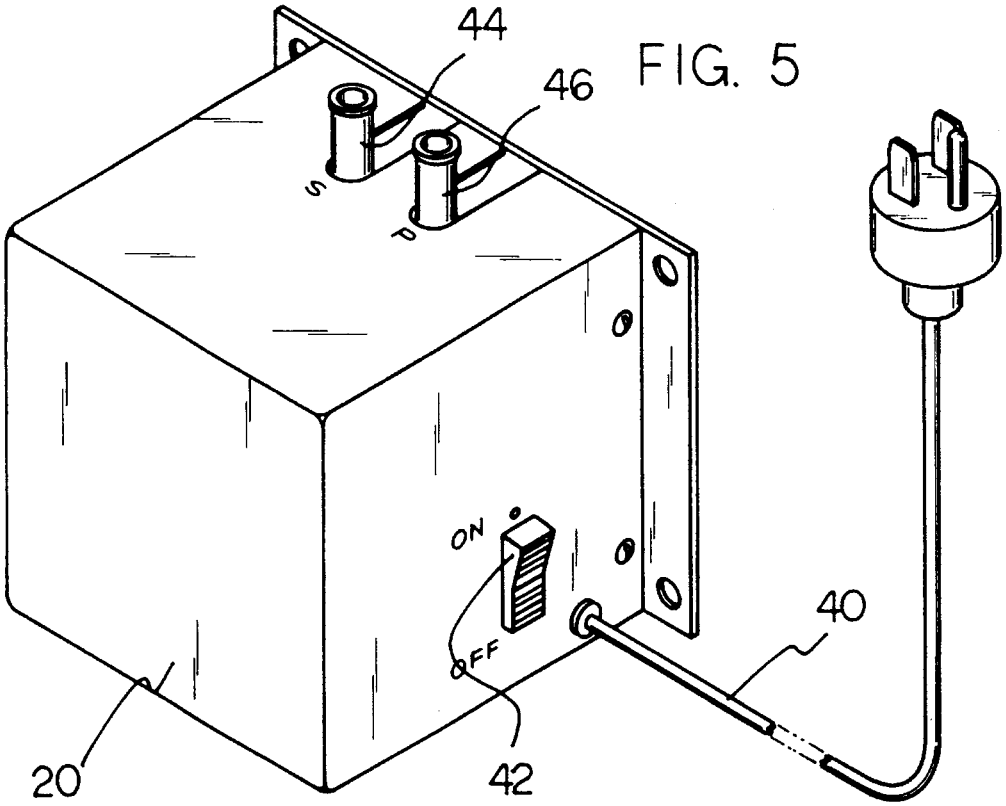
FIG. 5 is an isometric illustration of a demand pump comprising a portion of the present invention.
Figure 6:
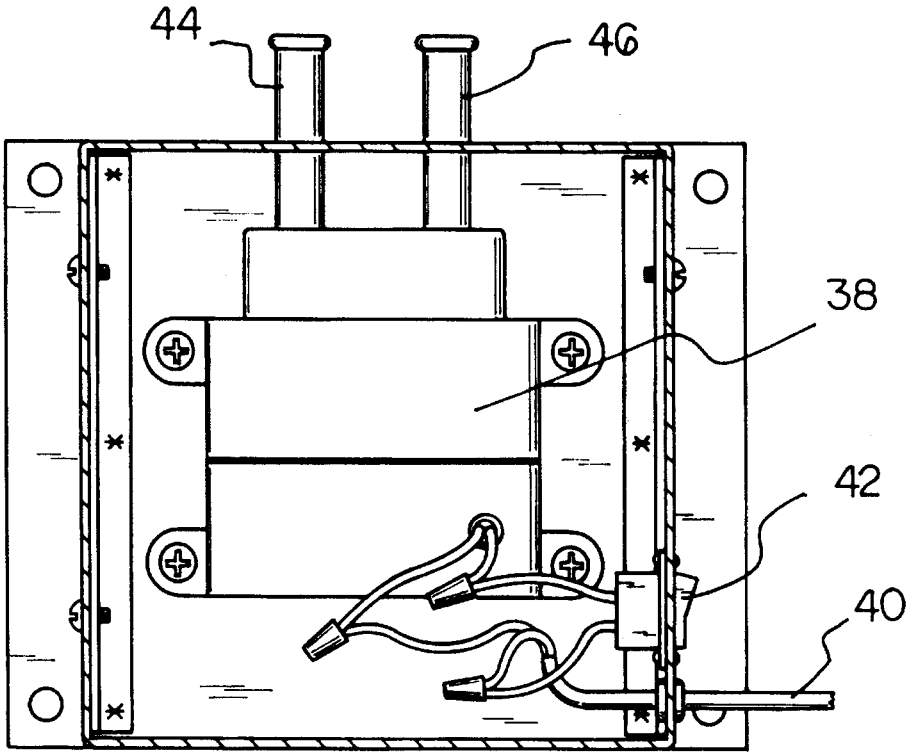
FIG. 6 is a cross sectional view of the demand pump.

Referring now to FIGS. 5 and 6 wherein the demand pump 20 is illustrated, it can be shown that the same comprises an electric pump 38 mounted within an unlabeled housing. Electricity is supplied to the electric pump 38 through a power cord 40 communicating with a manual switch 42 mounted to an exterior of the demand pump housing. The manual switch 42 operates to electrically coupled the power cord 40 to the electric pump 38 as prescribed an end user. The electric pump 38 includes an intake port 44 positioned into fluid communication with the intake conduit 18, and an output port 46 positioned into fluid communication with the output conduit 22. The electric pump 38 further includes an unillustrated interior pressure sensor responsive to pressure within the output port 46 such that energization of the electric pump 38 is commenced upon a dropping of pressure within the output port 46 below a predetermined level. By this structure, a manual energization of the electric pump 38 through an operation of the manual switch 42 will result in the generation of a predetermined fluid pressure within the output port 46 and the output conduit 22. When the faucet 26 or a device coupled to the auxiliary conduit 28 accepts fluid from the output conduit 22, the pressure sensor within the electric pump 38 will sense the drop in pressure within the output port 46 to commence operation of the electric pump 38. Upon closure of the faucet 26 and/or termination of water flow through the output conduit 22, pressure within the output port 46 will rise above the predetermined pressure, whereby the pressure sensor within the electric pump 38 will terminate operation thereof.

Figure 7:
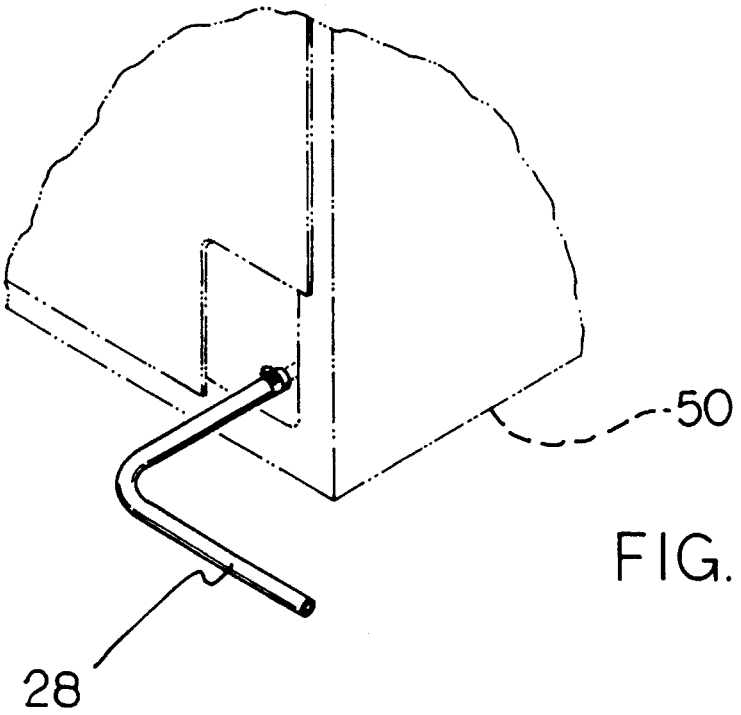
FIG. 7 is an isometric illustration of a portion of the present invention.
Figure 8:
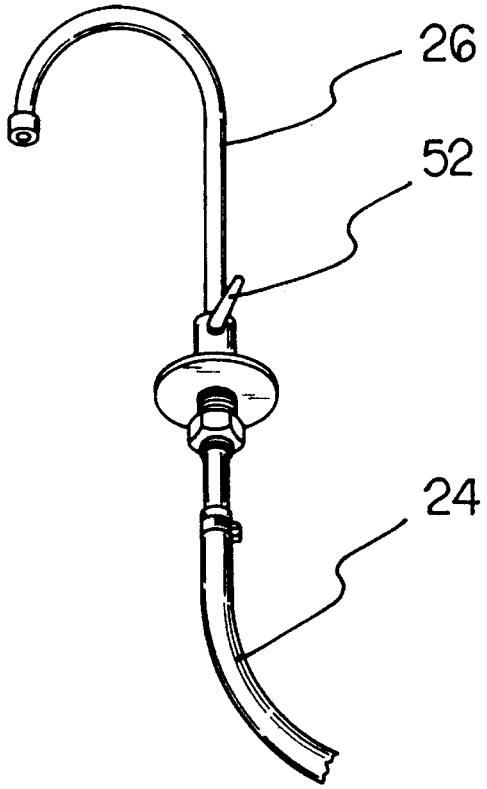
FIG. 8 is an isometric illustration of a further portion of the present invention.

As shown in FIG. 7, the auxiliary conduit 28 is preferably coupled to an ice-maker intake line of a refrigerator 50 so as to supply fresh water from the water bottle 12 thereto as described above. As shown in FIG. 8, the faucet 26 desirably includes a manual valve 52 permitting selective dispensing of water from the faucet conduit 24 into a sink or other desired area.

Figure 2:
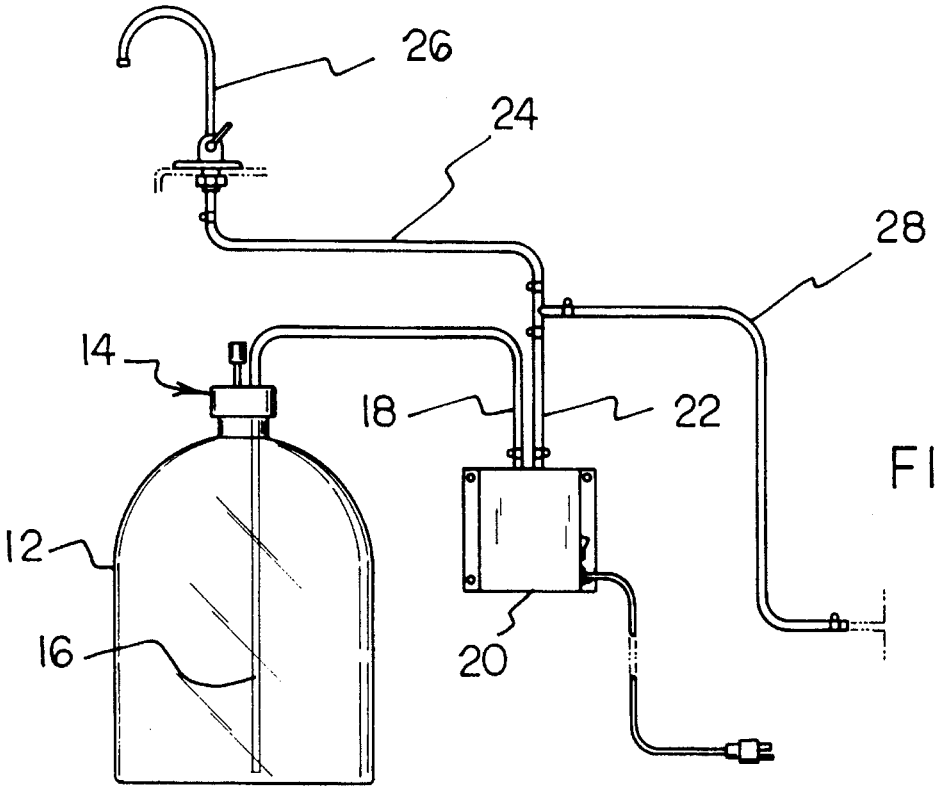
FIG. 2 is a front elevation view of the invention, per se.

In use, the bottled water supply system 10 according to the present invention can be easily utilized to supply bottled water from a commercially available water bottle 12 to either or both of a faucet 26 or a refrigerator ice-maker as shown in FIGS. 1 and 2 of the drawings.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A bottled water supply system comprising:

a water bottle for receiving and storing a quantity of fresh water, the water bottle being shaped so as to define a generally cylindrical body tapering to a neck of a reduced diameter;

a filter cap secured to the neck of the water bottle and including a sump conduit extending through an interior of the water bottle to terminate proximal to a lower end thereof, wherein the filter cap further comprises a closed cylindrical cap having a seal engaging the neck of the water bottle, a connector extending through the closed cylindrical cap and coupling the sump conduit to an intake conduit, an air filter means positioned into fluid communication with an interior of the water bottle for filtering air vented into the interior of the water bottle during removal of water therefrom;

a demand pump;

the intake conduit extending from the cap and in communication with the sump conduit to couple and fluidly communicate with the demand pump;

a faucet;

a faucet conduit in fluid communication with the faucet;

an output conduit extending from the demand pump and into fluid communication with the faucet conduit, wherein the demand pump operates to pump fluid from the water bottle and maintain a predetermined fluid pressure within the output conduit such that a pressure drop will effect automatic operation of the demand pump to supply water from the water bottle to the output conduit and the faucet conduit;

an auxiliary conduit means positioned into fluid communication with the output conduit for coupling the output conduit to a refrigerator including an ice-maker wherein the auxiliary conduit means is coupled to the ice-maker intake line of the refrigerator.

* * * * *